US012540470B2

(12) United States Patent
Mohebbi et al.

(10) Patent No.: US 12,540,470 B2
(45) Date of Patent: Feb. 3, 2026

(54) LOCKING BLOCKS AND METHODS OF USING SAME

(71) Applicant: Moxietec, LLC, Grove City, PA (US)

(72) Inventors: Abolfazl Mohebbi, Mississauga (CA); Donald Jordan, Townville, PA (US)

(73) Assignee: Moxietec, LLC, Grove City, PA (US)

( * ) Notice: Subject to any disclaimer, the term of this patent is extended or adjusted under 35 U.S.C. 154(b) by 298 days.

(21) Appl. No.: 18/487,968

(22) Filed: Oct. 16, 2023

(65) Prior Publication Data

US 2024/0125116 A1 Apr. 18, 2024

Related U.S. Application Data

(60) Provisional application No. 63/379,491, filed on Oct. 14, 2022.

(51) Int. Cl.
*E04B 2/18* (2006.01)

(52) U.S. Cl.
CPC ..... *E04B 2/18* (2013.01); *E04B 2103/04* (2013.01)

(58) Field of Classification Search
CPC ..... E04B 2/18; E04B 2103/04; E04B 2/08
See application file for complete search history.

(56) References Cited

U.S. PATENT DOCUMENTS 2,201,110 A * 5/1940 Makram ..... E04B 2/42 D25/113
4,107,894 A * 8/1978 Mullins ..... E04B 2/18 52/592.6
5,625,989 A 5/1997 Brubaker et al.
5,873,206 A 2/1999 Roberts
6,588,168 B2 7/2003 Walters
(Continued)

FOREIGN PATENT DOCUMENTS

FR 3002564 A1 8/2014
WO 00/28166 A1 5/2000
WO 20/22256663 A1 12/2022

OTHER PUBLICATIONS

Building with Waste: Interlocking Bricks Made From Waste Plastic https://nupliving.com/blogs/news/building-with-waste-interlocking-bricks-made-from-waste-plastic.
(Continued)

*Primary Examiner* — Patrick J Maestri
(74) *Attorney, Agent, or Firm* — Benesch Friedlander Coplan & Aronoff LLP

(57) ABSTRACT

Disclosed herein is a product and methods of using that product for constructing walls and other structures. The product is a locking block that is designed for use in building walls and other structures quickly and inexpensively. The locking blocks are fabricated from polymers to form a robust physical structure that resists damage and provides for a relatively clean work space during assembly. The locking blocks include matching male and female features that reversibly secure the blocks together and are self-aligning to guide workmen on block placement during assembly. The design of the blocks eliminates the need to apply mortar or other adhesive methods to secure the blocks together, which greatly reduces labor costs as compared to typical construction products and methods. Because no mortar or other adhesive is used, the blocks can be efficiently and effectively disassembled and reused.

20 Claims, 14 Drawing Sheets

(56) References Cited

U.S. PATENT DOCUMENTS

| | | | | |
|---|---|---|---|---|
| 8,176,697 | B1 * | 5/2012 | Bolander, II | E04G 21/185 52/309.4 |
| D763,365 | S * | 8/2016 | Timg | D21/501 |
| 2007/0130873 | A1 | 6/2007 | Fisher | |
| 2008/0029544 | A1 | 2/2008 | Margheritis et al. | |
| 2008/0295440 | A1 * | 12/2008 | Esterhuizen | E04B 2/18 52/606 |
| 2011/0146175 | A1 | 6/2011 | Forsberg et al. | |
| 2015/0089825 | A1 * | 4/2015 | Jones | G01B 5/25 33/518 |
| 2016/0002917 | A1 | 1/2016 | Rodriguez Carassus | |
| 2018/0347187 | A1 | 12/2018 | Parks et al. | |
| 2020/0157803 | A1 * | 5/2020 | Weber | E04B 2/18 |
| 2022/0064941 | A1 * | 3/2022 | Bowers | E04B 2/18 |
| 2022/0288502 | A1 | 9/2022 | Patel | |
| 2023/0287679 | A1 | 9/2023 | Felton et al. | |

OTHER PUBLICATIONS

International Search Report and Written Opinion issued in PCT application No. PCT/US23/77025, mailing date Jan. 30, 2024.

* cited by examiner

LOCKING BLOCKS AND METHODS OF USING SAME

CROSS-REFERENCE TO RELATED APPLICATIONS

The present application claims priority to U.S. provisional application Ser. No. 63/379,491, titled "Locking Block and Methods of Using Same," filed Oct. 14, 2022, which is hereby incorporated by reference herein.

FIELD OF INVENTION

The present disclosure generally relates to blocks that can be secured together to form an assembly. More specifically, the present disclosure relates to reusable blocks that include features that provide for the blocks to be reversibly secured together to form a temporary assembly that can be efficiently assembled and disassembled without modification to or damaging the blocks.

BACKGROUND

Walls and structures are often built using blocks fabricated from cement and aggregate, such as sand and gravel, and optionally cinders, such as fly ash or bottom ash. Such blocks are commonly referred to as cinder blocks. Cinder blocks are fabricated in a consistent size and are secured together by skilled workers using mortar applied between the cinder blocks. While use of cinder blocks is very common, there are significant drawbacks to the use of the product. Cinder blocks are relatively inexpensive to produce; however, the labor costs can be very high for skilled workers to assemble a wall or structure by applying mortar to each and every cinder block in the assembly. Because cinder blocks are relatively brittle, the number of blocks that are damaged in storage, transportation, handling, or during the construction of a wall or structure can significantly increase the cost. Additionally, workers must manually position each cinder block in the wall or other structure, and, if the workers are not of sufficient skilled, misalignment or other issues in the manual positioning of cinder blocks can result in walls and structures that deviate from the planned arrangement and dimensions. Furthermore, cinder blocks are a single use product. Because cinder blocks are attached using mortar, at the completion of any project, the wall or structure is permanent and the blocks are not reusable.

There is a need in the construction industry for a product to construct walls and structures that is reusable, efficiently assembled without the requirement for skilled manual labor, efficiently disassembles once the structure is no longer needed, and durable so that the product is not damaged in storage, transport, or during use. This disclosure describes such products and methods of assembling such products.

SUMMARY

Disclosed herein is a product and methods of using that product for constructing walls and other structures. The product is a locking block that is designed for use in building walls and other structures quickly and inexpensively. The locking blocks are fabricated from polymers to form a robust physical structure that resists damage and provides for a relatively clean work space during assembly. In one embodiment, the locking blocks are fabricated using an injection foam molding process to from a locking block that is lighter in weight. The locking blocks include matching male and female features that reversibly secure the blocks together and are self-aligning to guide workmen on block placement during assembly. In one embodiment, a top surface of the locking block includes six male features and six female features, and the bottom surface of the locking block also includes six male features and six female features. The design of the blocks eliminates the need to apply mortar or other adhesive methods to secure the blocks together, which greatly reduces labor costs as compared to typical construction products and methods. Because no mortar or other adhesive is used, the blocks can be efficiently and effectively disassembled and reused.

BRIEF DESCRIPTION OF THE DRAWINGS

In the accompanying drawings, structures are illustrated that, together with the detailed description provided below, describe example embodiments of the disclosed systems, methods, and apparatus. Where appropriate, like elements are identified with the same or similar reference numerals. Elements shown as a single component can be replaced with multiple components. Elements shown as multiple components can be replaced with a single component. The drawings may not be to scale. The proportion of certain elements may be exaggerated for the purpose of illustration.

DETAILED DESCRIPTION

Figure 1:
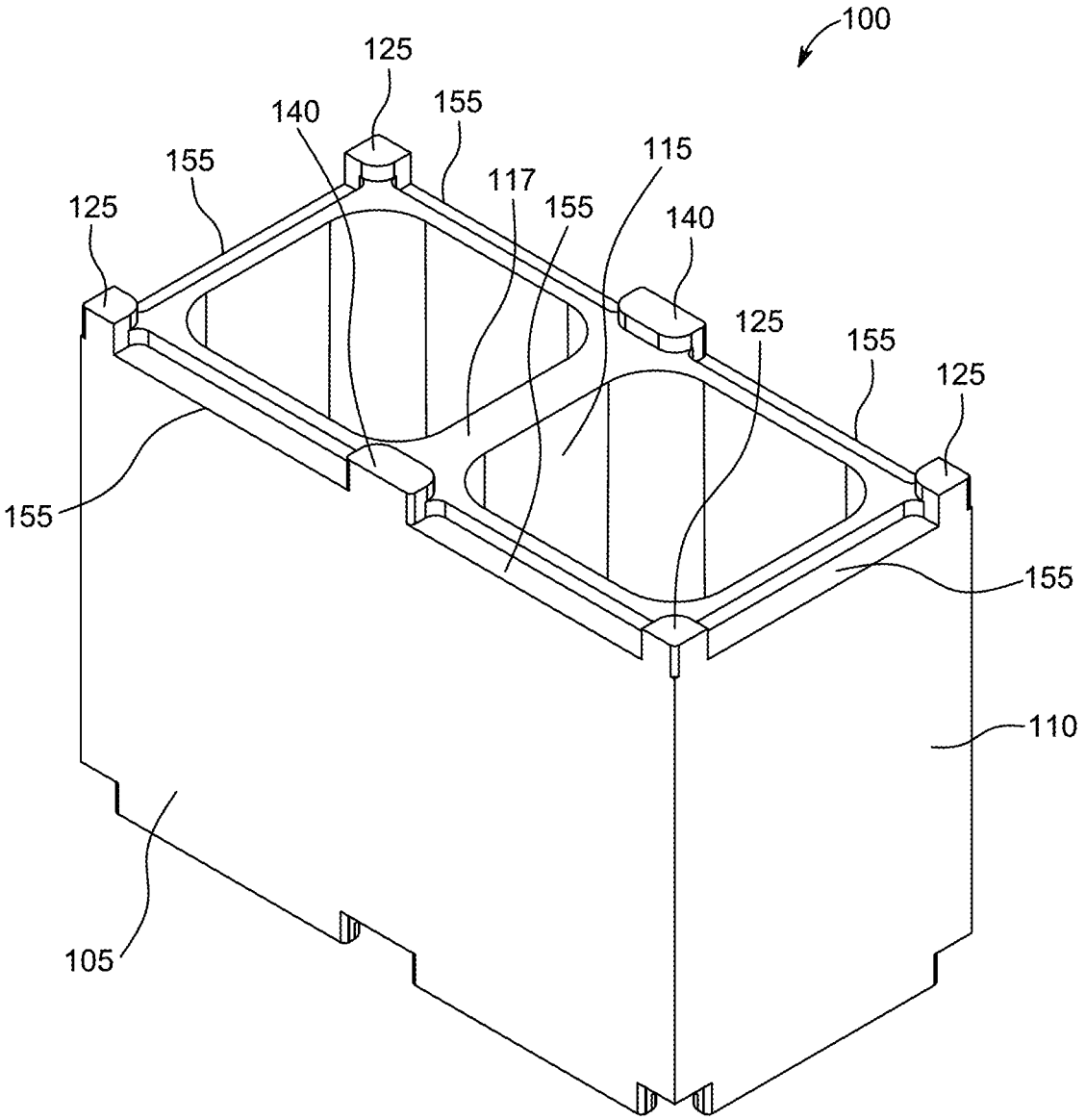
FIG. 1 schematically illustrates a perspective view from the top right of an exemplary locking block.

The apparatus, systems, arrangements, and methods disclosed in this document are described in detail by way of examples and with reference to the figures. It will be appreciated that modifications to disclosed and described examples, arrangements, configurations, components, elements, apparatus, methods, materials, etc. can be made and may be desired for a specific application. In this disclosure, any identification of specific techniques, arrangements, method, etc. are either related to a specific example presented or are merely a general description of such a technique, arrangement, method, etc. Identifications of specific details or examples are not intended to be and should not be construed as mandatory or limiting unless specifically designated as such. Selected examples of locking blocks and methods of assembling locking blocks are hereinafter disclosed and described in detail with reference made to FIGS. 1 through 14.

Disclosed herein are novel and innovative locking blocks for use in reversibly, inexpensively, and efficiently constructing walls and other structures. The locking blocks include interlocking mechanisms that provide for the stacking and locking of blocks in rows on top of one another. The interlocking mechanism includes male and female features on the top and bottom of each block that align the blocks as they are assembled and reversibly locks the blocks together without the need of mortar or any other adhesive. The design of the locking blocks, including the interlocking mechanisms, provide for stacking the blocks in a single wall arrangement, stacking the blocks in a double-wall arrangement, and creating ninety degree corners in both single and double wall arrangements.

The locking blocks can be fabricated from a broad variety of materials. In one example, the locking blocks are fabricated from one or more polymers using an injection molding or foam injection molding process. The locking blocks can be injection molded using recycled polymer materials. In other examples, locking blocks can be produced through compression molding, additive manufacturing, or any other number of processes. Other materials that can be used to fabricate locking blocks include thermoplastic polymers, a blend of thermoplastic polymers, thermoset resins, polystyrene, styrene acrylonitrile (SAN), polycarbonates, polypropylene, polyethylene, a blend of polypropylene and polyethylene, elastomers, wood, etc. Additives can also be used, such as minerals, organic additives, pigments, elastomer, crosslinkers, etc.

As noted above, the design of the locking blocks eliminates the need for mortar or other adhesive methods to secure the locking blocks together, which greatly reduces labor costs as compared to typical construction products and methods. Because no mortar or other adhesive is used, the blocks can be easily disassembled and reused. An advantage of the locking blocks described herein is that they are lighter in weight as compared to traditional cinder blocks. Another advantage is that the locking blocks are environmentally friendly in that they can be made from 100% recyclable materials and can themselves be recycled at the end if their useful service life. Yet other advantages include: polymer materials are inherently thermally resistant, particularly when made from foamed polymers, and significantly more thermal resistance than traditional cinder block materials; polymer materials are resistant to harsh weather conditions including rain and snow; coatings, such as fire resistant coatings, can be applied easily to the locking blocks with the use of a primer; and polymer locking blocks can be cut with traditional cutting techniques to accommodate unique circumstances.

Figure 2:
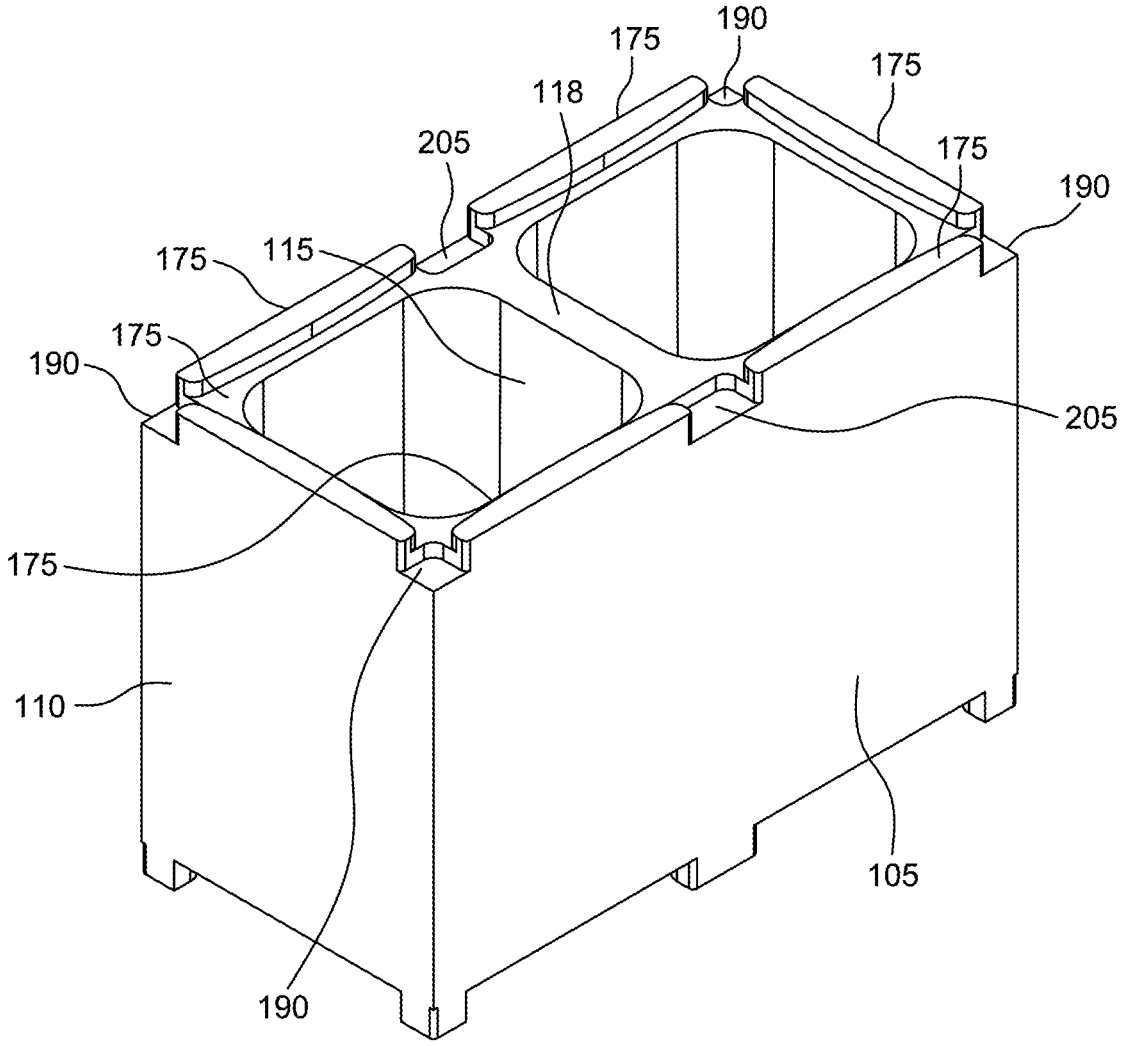
FIG. 2 schematically illustrates a perspective view from the bottom left of the locking block of FIG. 1.
Figure 3:
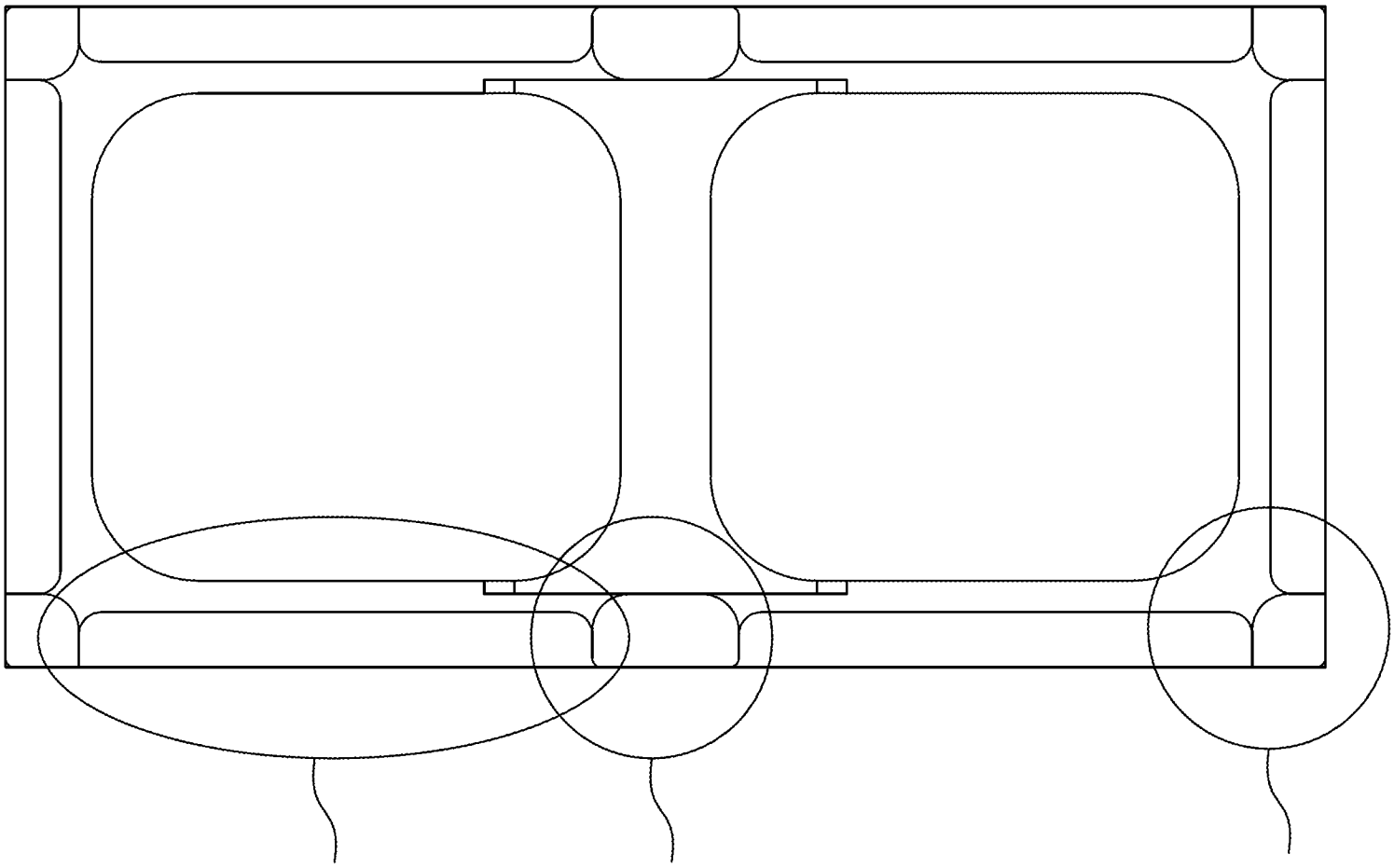
FIG. 3 schematically illustrates a top plan view of the locking block of FIG. 1.
Figure 4A:
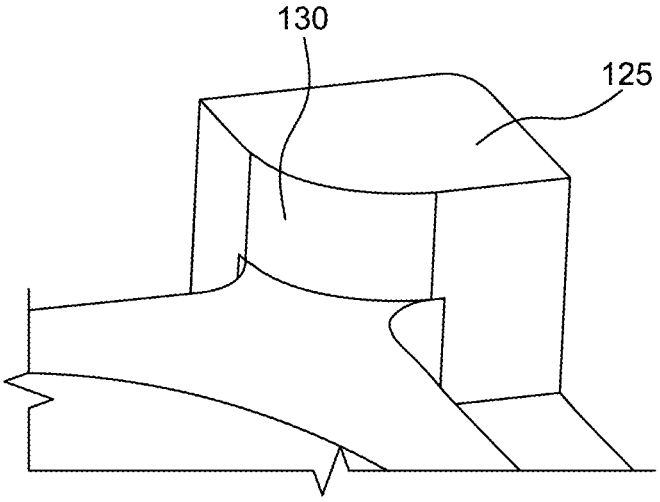
FIG. 4A schematically illustrates a detailed view identified in FIG. 3 of a first male feature on the top side of the locking block of FIG. 1.
Figure 4B:
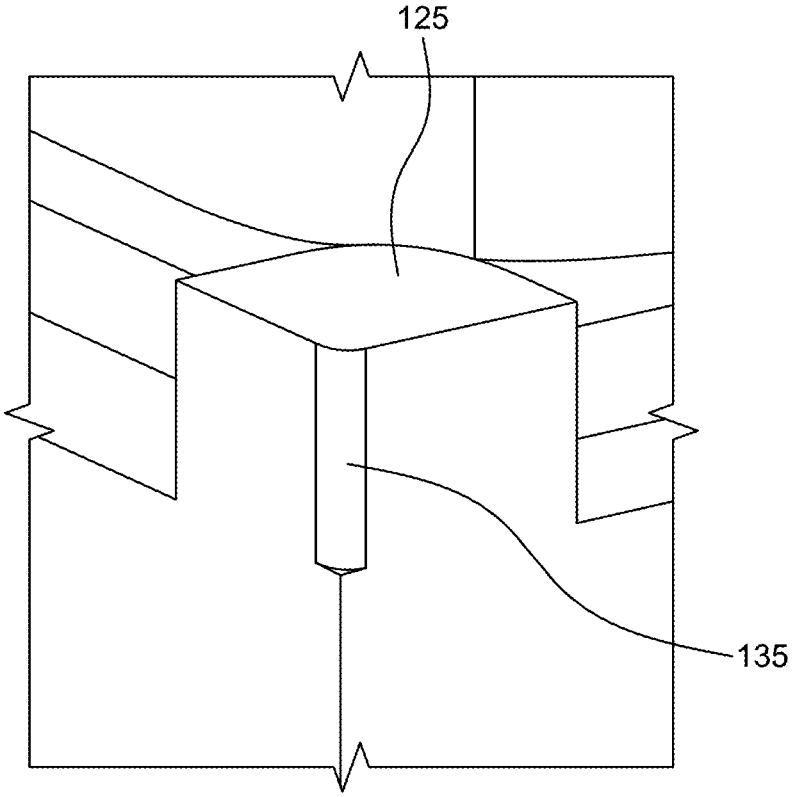
FIG. 4B schematically illustrates another detailed view identified in FIG. 3 of the first male feature on the top side of the locking block of FIG. 1.
Figure 5A:
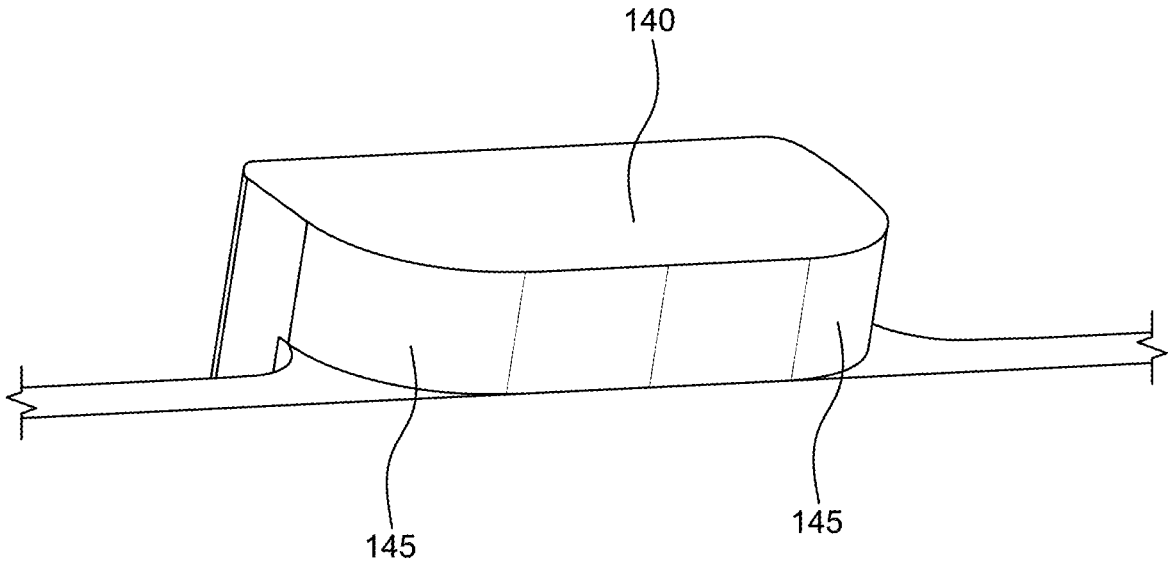
FIG. 5A schematically illustrates a detailed view identified in FIG. 3 of a second male feature on the top side of the locking block of FIG. 1.
Figure 5B:
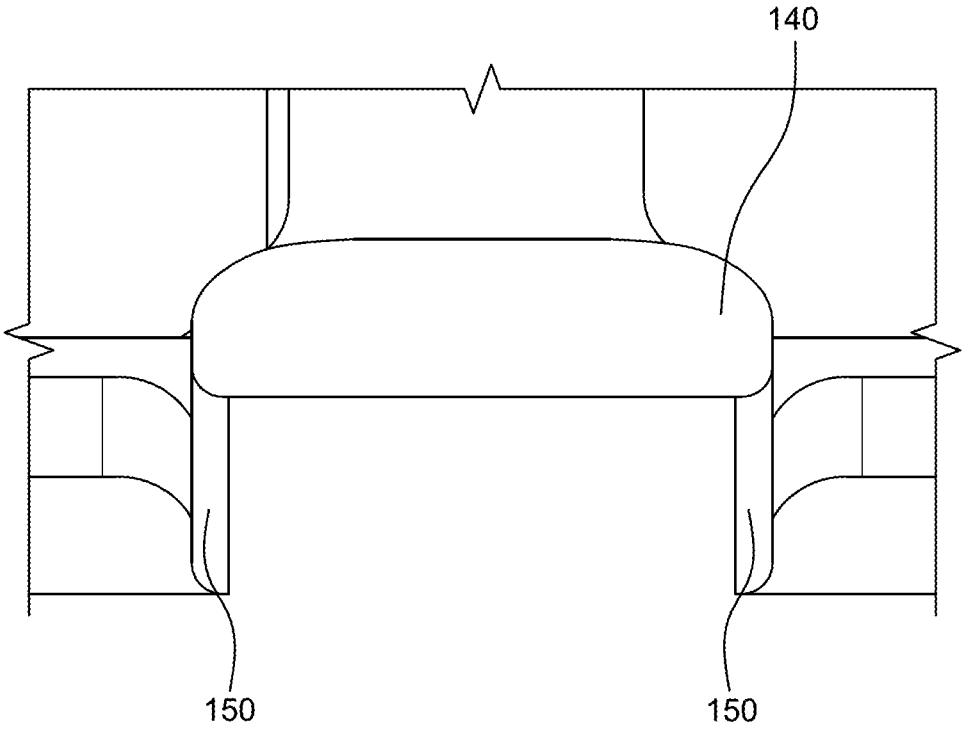
FIG. 5B schematically illustrates another detailed view identified in FIG. 3 of the second male feature on the top side of the locking block of FIG. 1.
Figure 6:
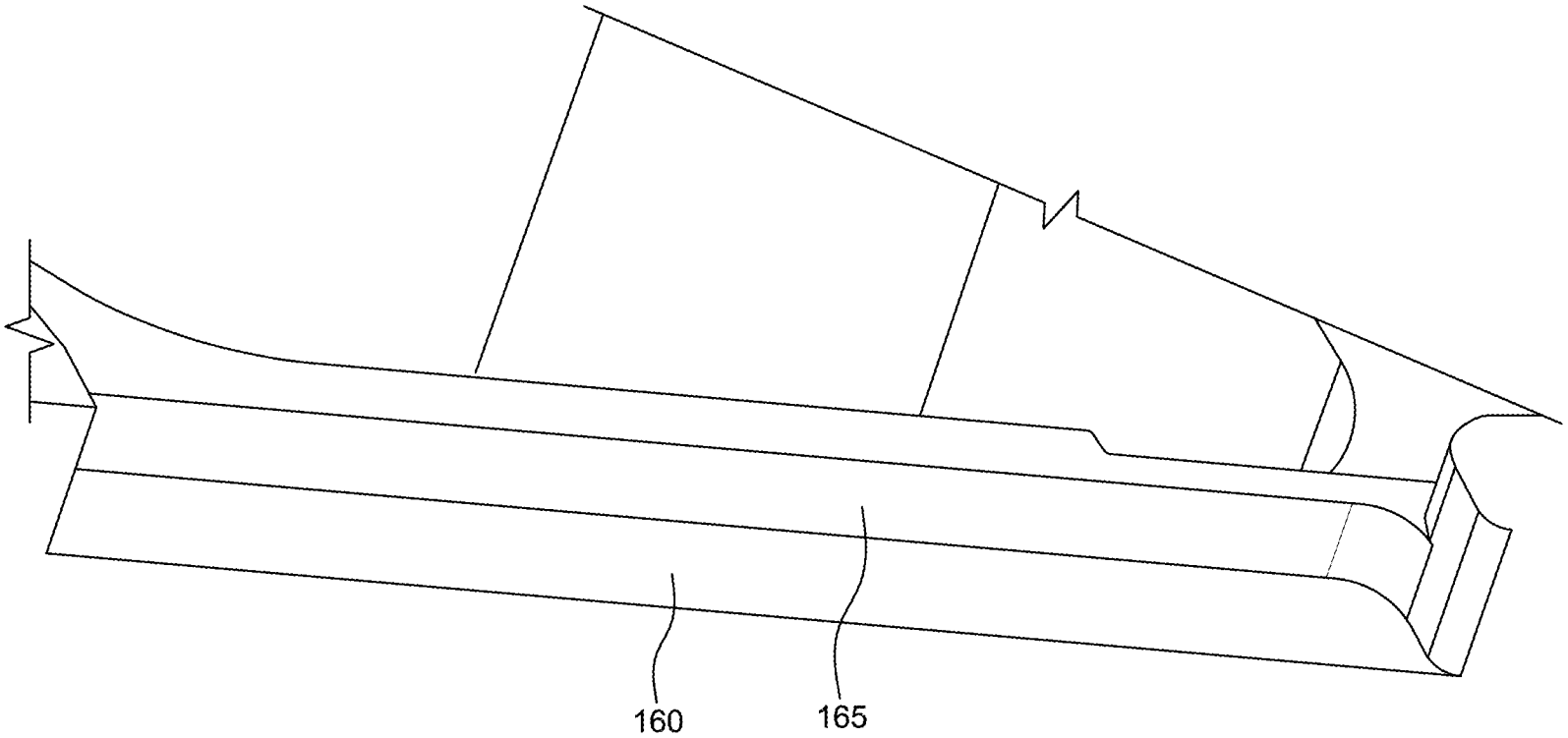
FIG. 6 schematically illustrates a detailed view identified in FIG. 3 of a female feature on the top side of the locking block of FIG. 1.
Figure 7:
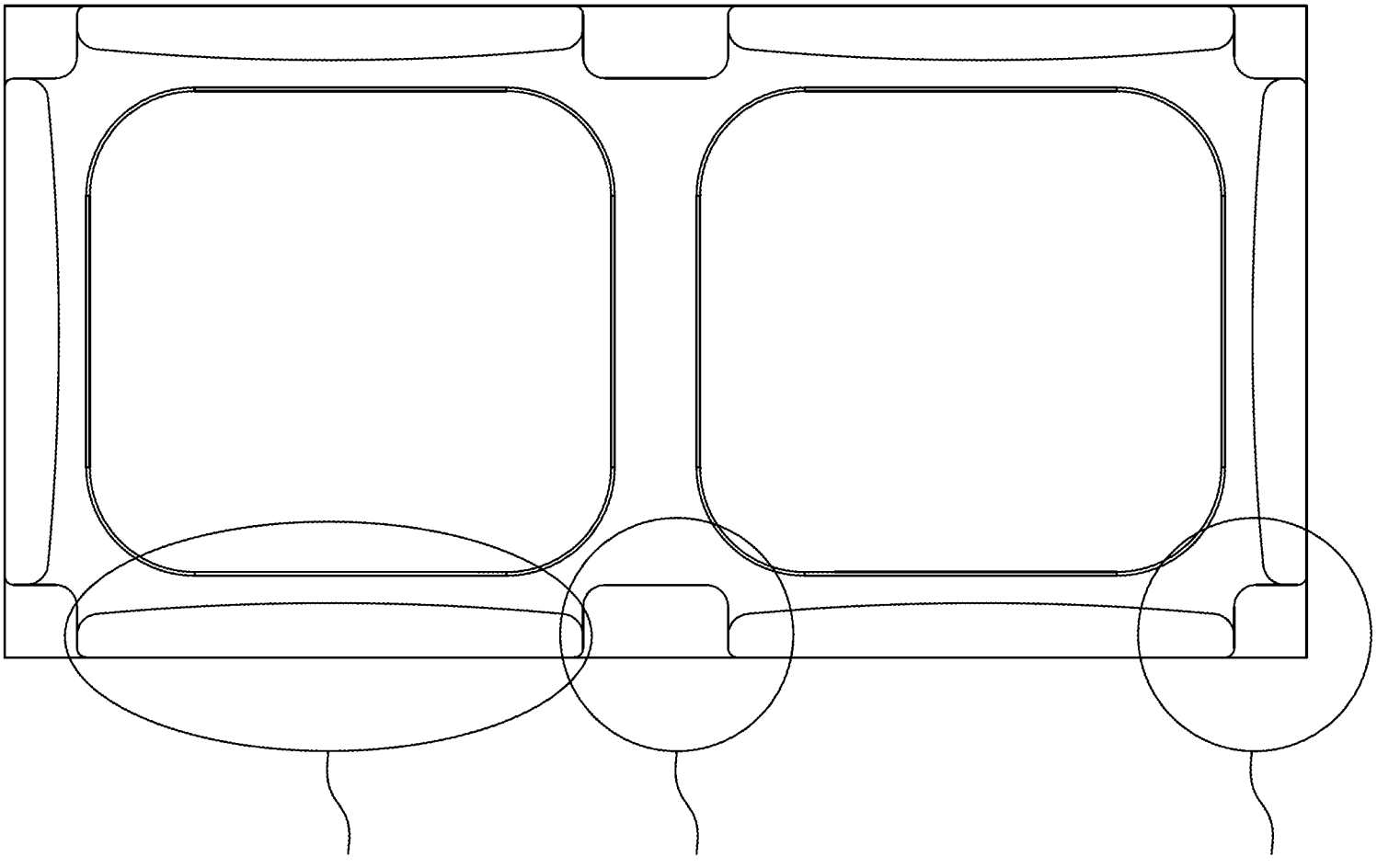
FIG. 7 schematically illustrates a bottom plan view of the locking block of FIG. 1.

FIGS. 1 through 10 illustrate an exemplary locking block 100. FIG. 1 illustrates a top perspective view of the locking block 100, and FIG. 2 illustrates a bottom perspective view of the locking block 100. FIG. 3 is a top plan view of the locking block 100, and FIGS. 4A, 4B, 5A, 5B, and 6 are enhanced perspective views of features on the top surface of the locking block 100. FIG. 7 is a bottom plan view of the locking block 100, and FIGS. 8, 9A, 9B, 10A, and 10B are enhanced perspective views of features on the bottom surface of the locking block 100. As illustrated in the figures, the top and bottom surfaces of the locking block 100 include combinations of male and female features that engage to form a robust locking mechanism. It will be understood that the terms "top," "bottom," "upward," "downward," and the like are merely relative to the figures as presented and are used for ease of description of the locking block 100. Such terms can be interchanged without departing from the disclosure herein.

The locking block 100 includes an outer shell comprising four walls, a pair of opposing long walls 105 and a pair of opposing short walls 110 that combine to form a rectangular outer shell. In the embodiment illustrated in FIGS. 1-10, the locking block 100 includes long walls 105 that are greater in length than the length of the short walls 110, thus forming a rectangle. However, it will be appreciated that a locking block can be arranged such that all four walls are equal in length and thus, form a square shaped locking block. The exemplary locking block 100 further includes a central wall 115 that is positioned at the midpoints of and connects the long walls 105. The central wall includes a top surface 117 (as best illustrated in FIG. 1) and a bottom surface 118 (best illustrated in FIG. 2). The top surface 117 is recessed from the top surface of the locking block 100 and, as will subsequently be described, functions as a female feature. The bottom surface 118 is recessed from the bottom surface of the locking block 100. It will be appreciated that such a central wall 115 adds strength and stability to the locking block 100.

As best illustrated in FIGS. 1 and 3-6, the top surface of the locking block 100 includes six protrusions extended upwards from the top surface. These protrusions are also referred to as a "male feature." There are four male features 125 extending upwards from the four corners of the top surface of the locking block 100. These male features 125 are generally cube shaped with two opposing truncated corners. This is to say that two of the four corners of the cube are rounded (as best illustrated in FIGS. 4A and 4B). The first rounded corner 130 of the male feature 125 is facing inward relative to the locking block 100, and the second rounded corner 135 of the male feature 125 is facing outward relative to the locking block 100. In the example illustrated in the figures, the radius of the first rounded corner 130 is greater than the radius of the second rounded corner 135. In one example, the radius of the first rounded corner 130 is between approximately 0.25 inches and 0.75 inches, with one embodiment including a first rounded corner 130 with a radius of approximately 0.50 inches. In one example, the radius of the second rounded corner 135 is between approximately 0.10 inches and 0.40 inches. In one embodiment, the radius of the second rounded corner 135 is approximately 0.13 inches, in another embodiment, the radius of the second rounded corner 135 is approximately 0.30 inches.

Two additional male features 140 are positioned at the midpoint of the long walls 105. These male features 140 are generally cuboids (i.e., a "rectangular cubes") with all four corners truncated (i.e., rounded, as best illustrated in FIGS. 5A and 5B). The sides of the male feature 140 that are parallel to the long wall 105 are longer in length than the sides of the male feature 140 that are perpendicular to the long wall 105. In the example illustrated in the figures, the two corners 145 that are toward the interior of the locking block have radii that are equal to each other and are greater than the radii of the two corners 150 that are toward the exterior of the locking block 100 (which are also equal to each other). In one example, the radius of the first rounded corner 145 is approximately between approximately 0.25 inches and 0.75 inches, with one embodiment including a first rounded corner 145 with a radius of approximately 0.50 inches. In one example, the radius of the second rounded corner 150 is between approximately 0.10 inches and 0.40 inches. In one embodiment, the radius of the second rounded corner 150 is approximately 0.13 inches, in another embodiment, the radius of the second rounded corner 150 is approximately 0.30 inches.

The top surface further includes six recessions extended downward from the top surface of the locking block 100 and into the walls 105, 110 of the locking block 100. Each of these recessions is also referred to as a "female feature." There is one female feature 155 located along the top surface of each of the short walls 110 and two female features 160 located along the top surface of each of the long walls 110. All six female features 160 are generally rectangular is shape (when viewed from the top plan perspective) and are equally sized and shaped. For the female feature 155 located on the short wall 110, the female feature 155 is bounding on each opposing end by one of the male features 125 positioned at the corners of the locking block 100, bound on the side facing internally to the locking block 100 by a wall 165, and unbounded (i.e., open) on the side facing externally from the locking block 100. For the female features 160 located on the long wall 105, each female feature 160 is bounding on one end by a male feature 125 positioned at the corner of the locking block 100 and bounded on the opposite end by the male feature 140 positioned at the midpoint of the long wall 105. The female feature is further bound by the wall 165 of the locking block 100, with the front of the female feature 160 unbound (i.e., open). As illustrated in FIG. 6, the interior corners 170 of the female feature 160 are rounded, with the radius of the interior corners 170 between approximately 0.10 inches to 0.40 inches. In one embodiment, the interior corners 170 are approximately 0.3 inches. In another embodiment, the interior corners 170 are approximately 0.13 inches.

Figure 8A:
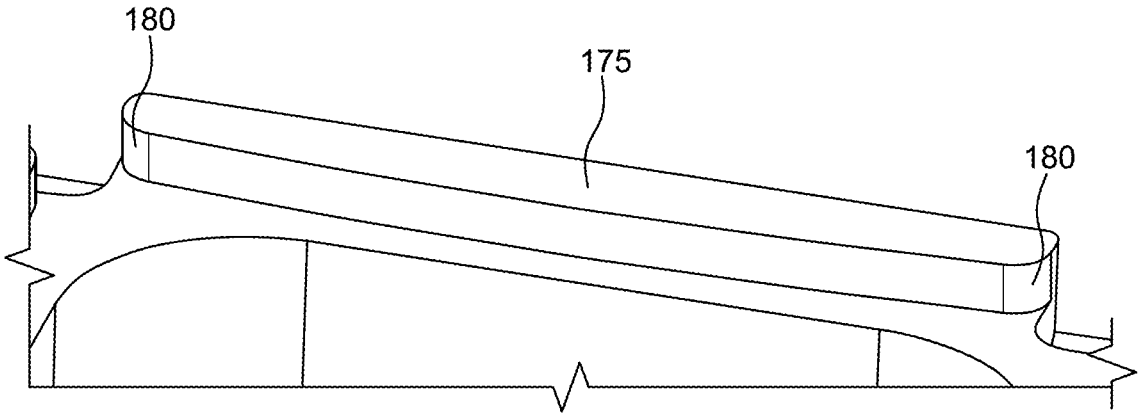
FIG. 8A schematically illustrates a detailed view identified in FIG. 7 of a male features on the bottom side of the locking block of FIG. 1.
Figure 8B:
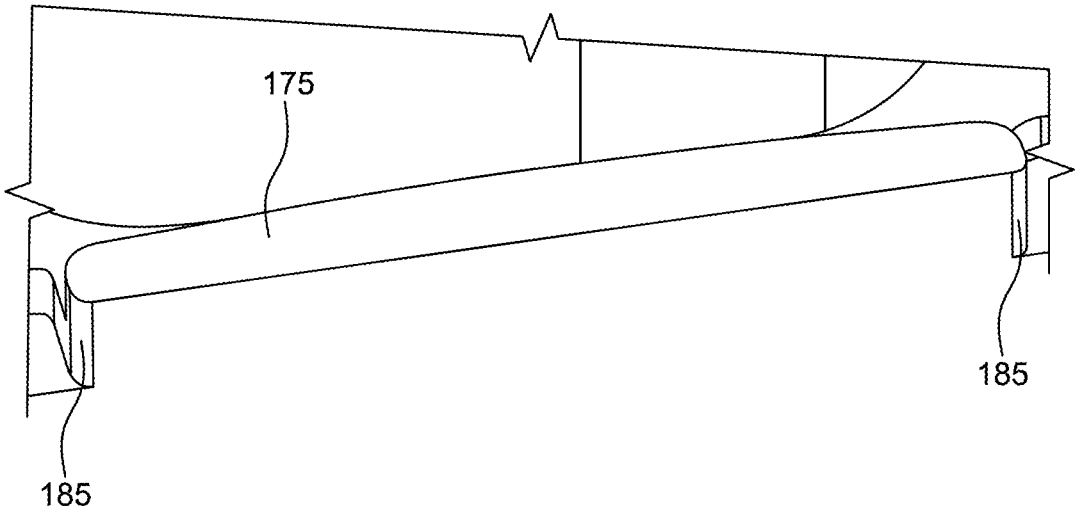
FIG. 8B schematically illustrates another detailed view identified in FIG. 7 of the male features on the bottom side of the locking block of FIG. 1.

The bottom surface is essentially a mirror image of the top surface. As best illustrated in FIGS. 2 and 7-10B, the bottom surface of the locking block 100 includes six protrusions 175 extended downwards from the bottom surface. These protrusions are also referred to as "male features." The male features 175 are generally cuboids with truncated corners, and all six male features 175 are equally shaped and sized. There is one male feature 175 positioned on each short wall 110 and two male features 175 positioned on each long wall 105. The male feature 175 on each short wall 110 is centrally located, and the pair of male features 175 on each long wall 105 are located side by side and separated by a female feature (as will be further described herein). As illustrated in FIGS. 8A and 8B, the two corners 180 of the male feature 175 facing inward to the locking block 110 have a radius that is greater than the radius of the corners of the male feature 170 that are facing outward 185. In one example, the radius of the inward facing corners 180 is between approximately 0.10 inches and 0.40 inches. In one embodiment, with one embodiment having an inward facing corner 180 radius of 0.30 inches. The radius of the outward facing corners 185 is between approximately 0.10 inches to 0.40 inches, with one embodiment having a radius of 0.13 inches.

Figure 9:
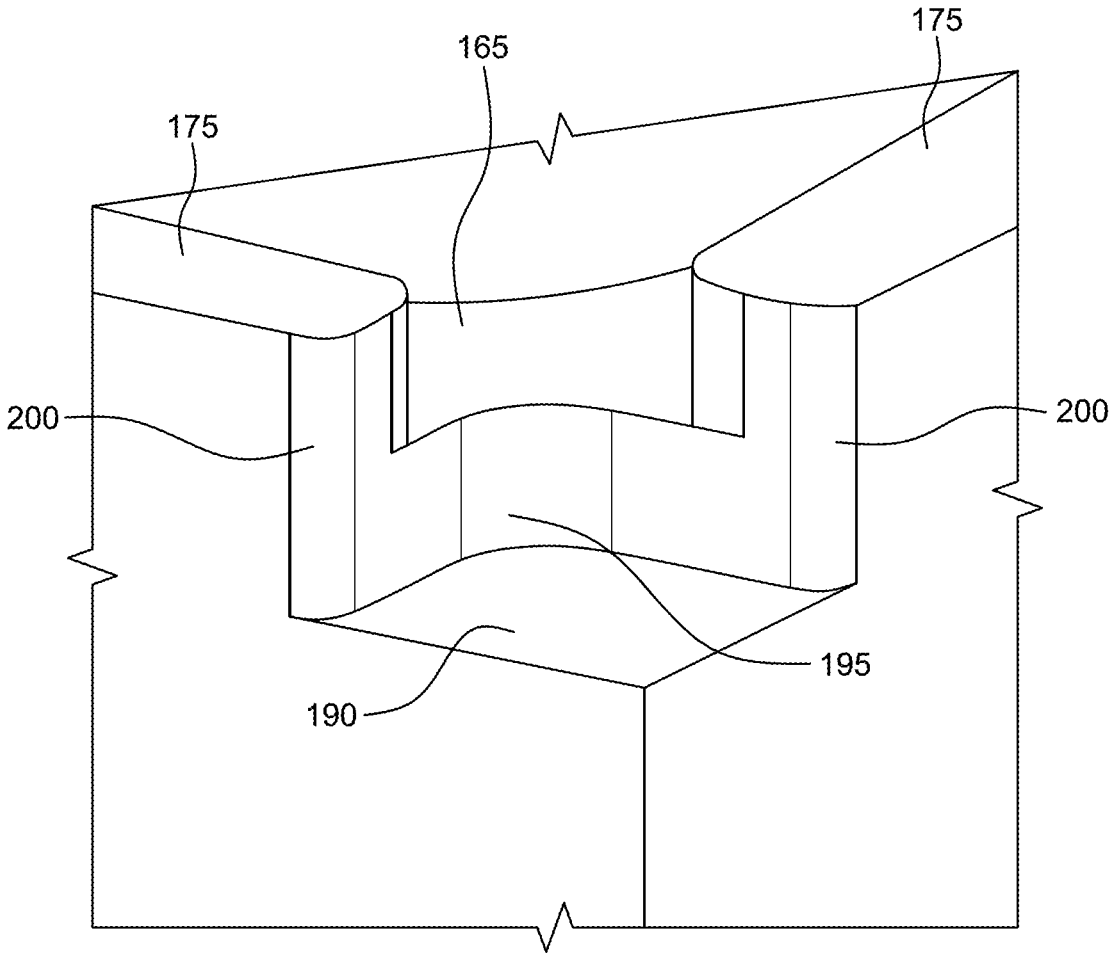
FIG. 9 schematically illustrates a detailed view identified in FIG. 7 of a first female feature on the bottom side of the locking block of FIG. 1.

There are four female features 190 located at each of the four corners of the bottom side of the locking block 100. As illustrated in FIG. 9, the female features 190 are bounded on two sides by male features 175 and the wall 165 of the locking block 100 and unbounded (i.e., open) on the two sides facing externally from the locking block 100. An internal corner 195 of the female feature is rounded, and the two outer corners 200 of the female feature are rounded. In one example, the radius of the internal corners 195 is between approximately 0.10 inches and 0.40 inches, with one embodiment having a radius of approximately 0.30 inches. The radius of the outer corners 200 is between approximately 0.10 inches and 0.40 inches, with one embodiment having a radius of approximately 0.13 inches.

Figure 10A:
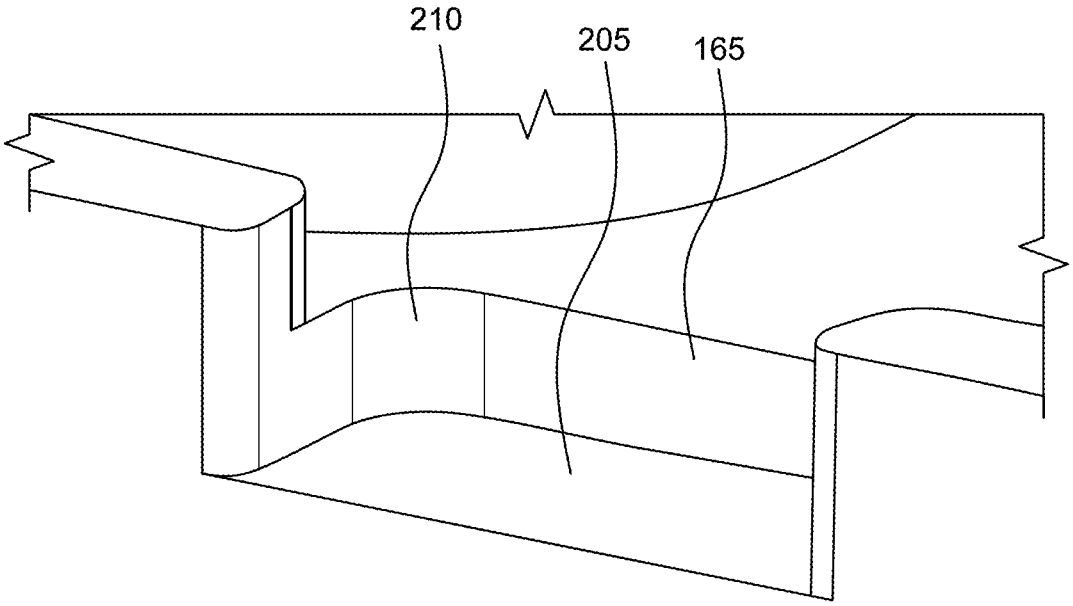
FIG. 10A schematically illustrates a detailed view identified in FIG. 7 of a second female feature on the bottom side of the locking block of FIG. 1.
Figure 10B:
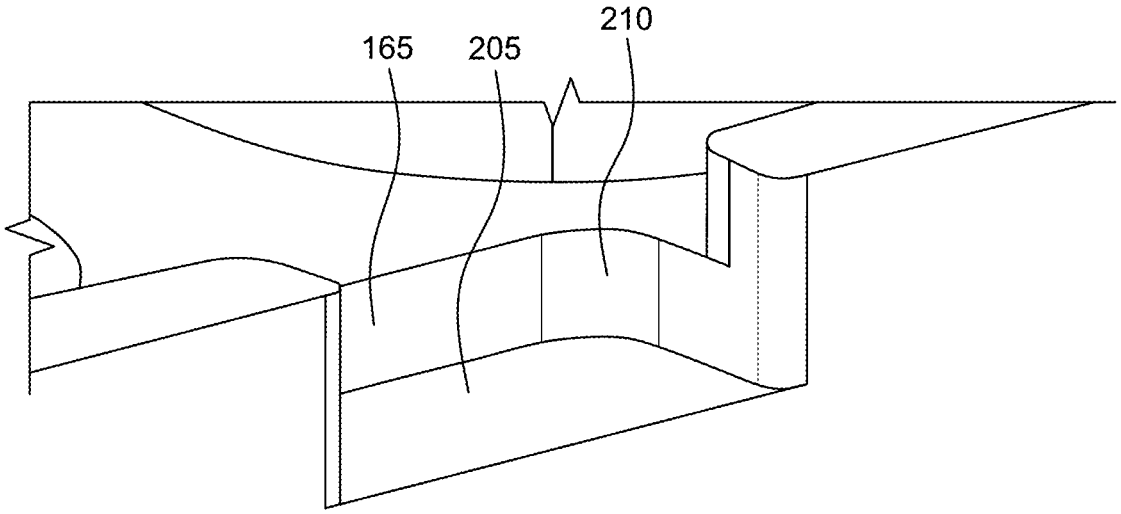
FIG. 10B schematically illustrates another detailed view identified in FIG. 7 of the second female feature on the bottom side of the locking block of FIG. 1.

There is one female feature 205 located at the midpoint of each long wall 105. As illustrated in FIGS. 10A and 10B, the female features 205 are bounded on two opposing sides by male features 175, bound on the side facing internally to the locking block 100 by the internal wall 165 of the locking block 100, and unbounded (i.e., open) on the side facing externally from the locking block 100. The internal corners 210 of the female feature 205 are rounded, with a radius of between approximately 0.10 inches and 0.40 inches. In one embodiment, the radius of the internal corners is 0.30 inches. The radius of the external corners 215 of the female feature 205 is between approximately 0.10 inches and 0.40 inches, with one embodiment of the radius of the external corners 215 being approximately 0.26 inches.

The male features positioned on the top side of the locking block 100 and the female features positioned on the bottom side of the locking block 100 are arranged to engage with each other. Additionally, the male feature positioned on the bottom side of the locking block 100 and the female feature positioned on the top side of the locking block 100 are arranged to engage with each other. The shape, size, and overall dimensions of the male features and the female features, including the truncated and rounded corners, are compatible with reversibly securing the locking blocks 100 together to form a wall or other assembly, and during assembly, the locking blocks 100 will self-align to assist workmen in positioning the locking blocks 100 during assembly.

In one example, the overall dimensions of the locking block 100 are 18 inches in length (i.e., along the long wall 105), 9 inches in width (i.e., along the short wall 110), and 12 inches in height. These dimensions are without including the male features raising from the top and top surface. The long walls 105 and short walls 110 are each approximately between 0.65 inches to 1.5 inches in thickness, with one embodiment 1.125 inches in thickness, and the central wall 115 is between approximately 0.50 inches to 1.25 inches in thickness, with one embodiment 1 inch in thickness. The male features 125 located at the corners of the locking block 100 are approximately 1 inch in length and width (excluding the rounded corner), and the male features 135 located at the midpoint of the long wall 105 are approximately 1 inch in width and 2 inches in length (excluding the rounded corners).

Figure 11:
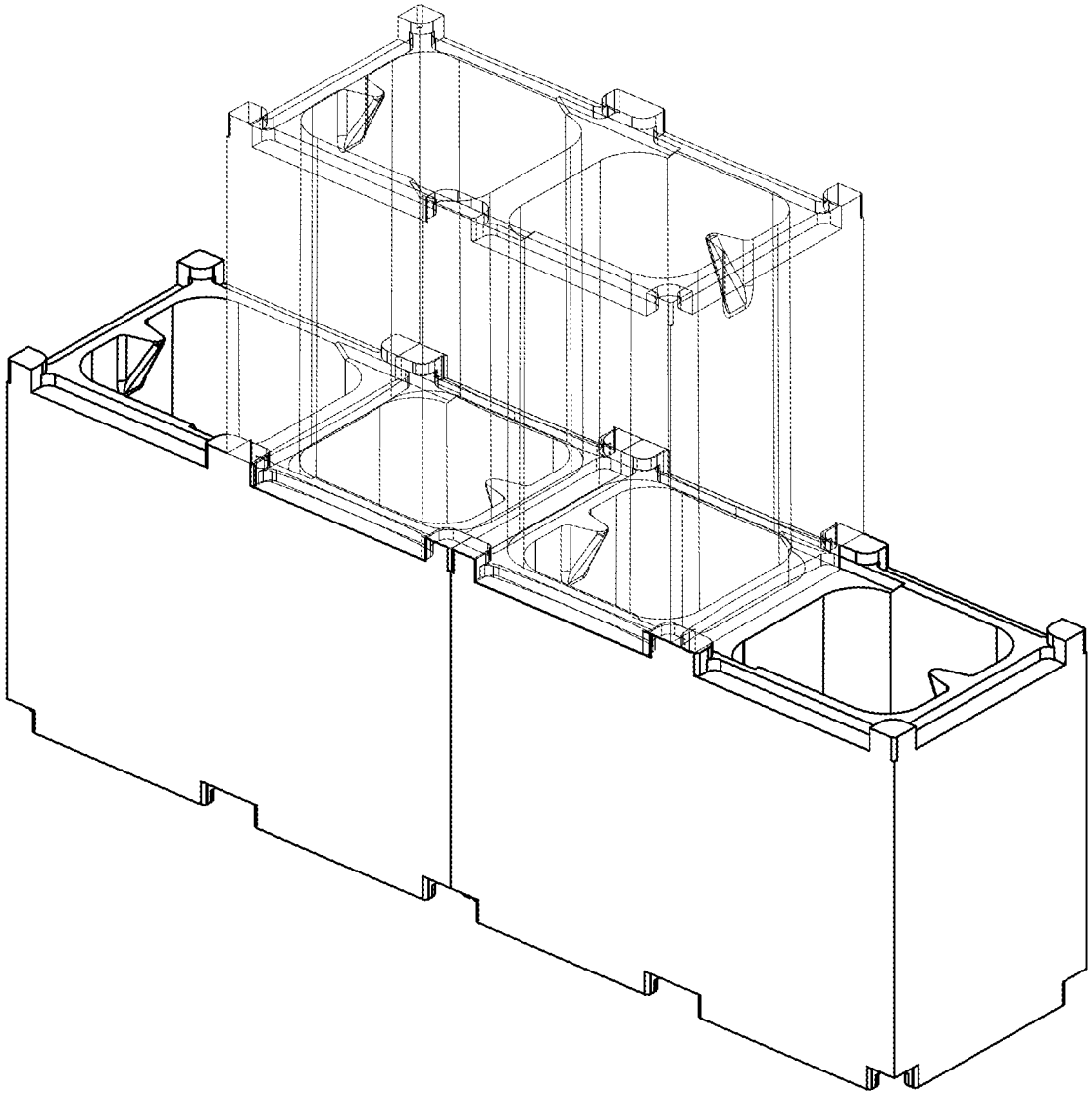
FIG. 11 schematically illustrates typical construction of a single block wall using the locking blocks of FIG. 1, with a block in the second row illustrated as semi-transparent to better show details of the engagement of male and female features.

FIG. 11 illustrates the start of assembling a wall with the locking blocks 100 described herein. One locking block is stacked on a pair of locking blocks with the female and male features engaged. Such an arrangement can be used to form a single block wall. As is illustrated, the locking blocks on the second row is shifted horizontally one-half block length similar to any conventional brick laying process. This arrangement continues on for each subsequent row of locking blocks.

Figure 12:
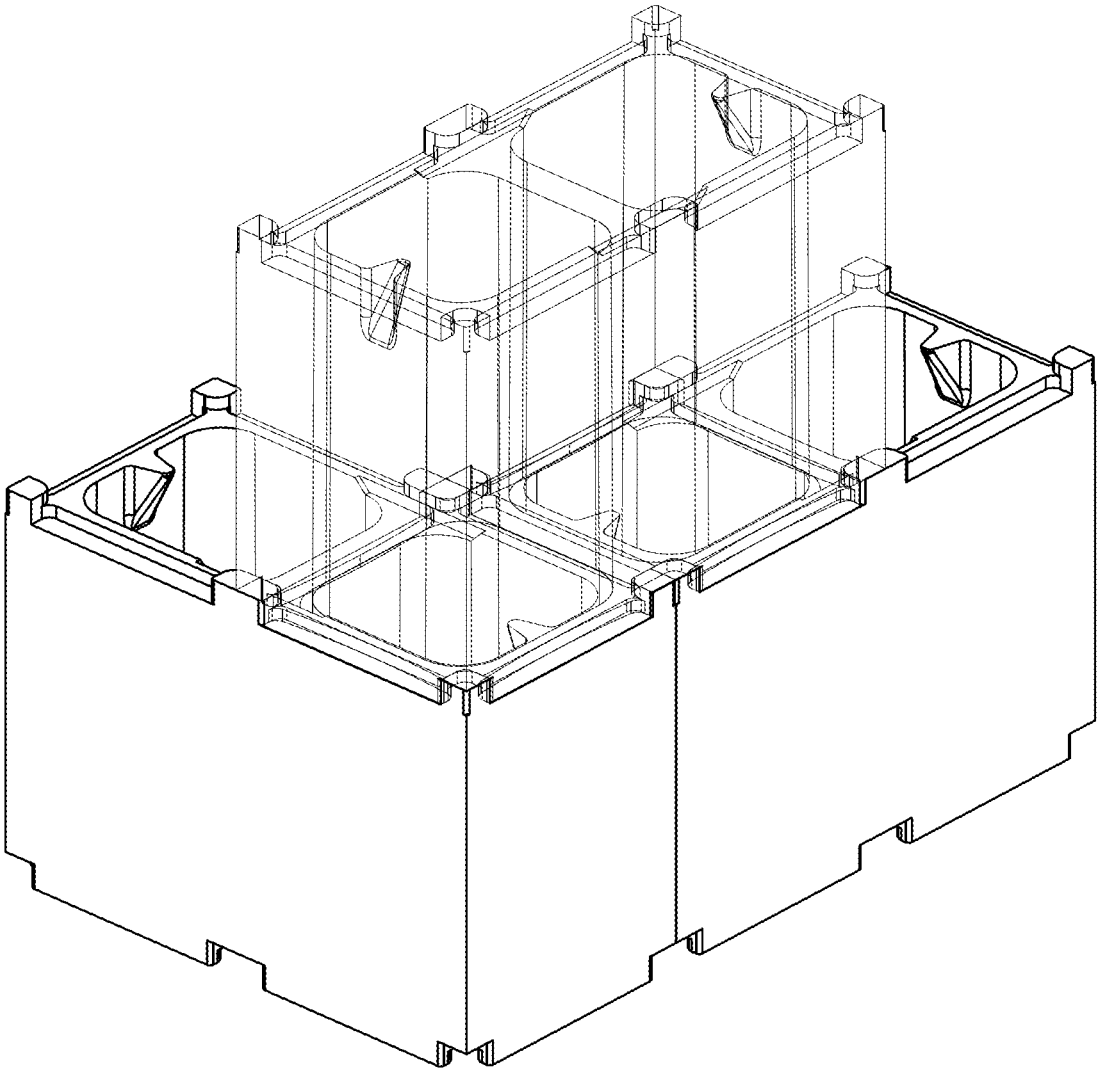
FIG. 12 schematically illustrates typical construction of a corner of a single block wall using the locking blocks of FIG. 1, with a block in the second row illustrated as semi-transparent to better show details of the engagement of male and female features.
Figure 13:
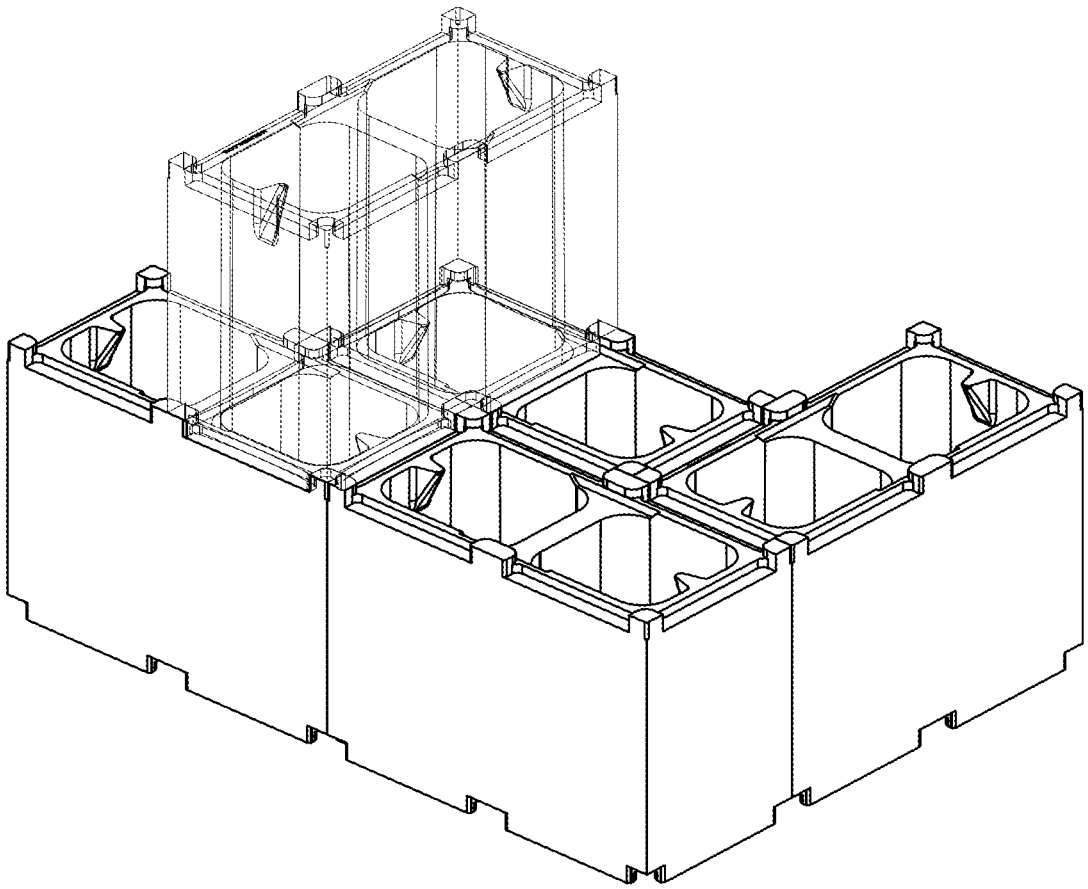
FIG. 13 schematically illustrates typical construction of a double block wall using the locking blocks of FIG. 1, with a block in the second row illustrated as semi-transparent to better show details of the engagement of male and female features.
Figure 14:
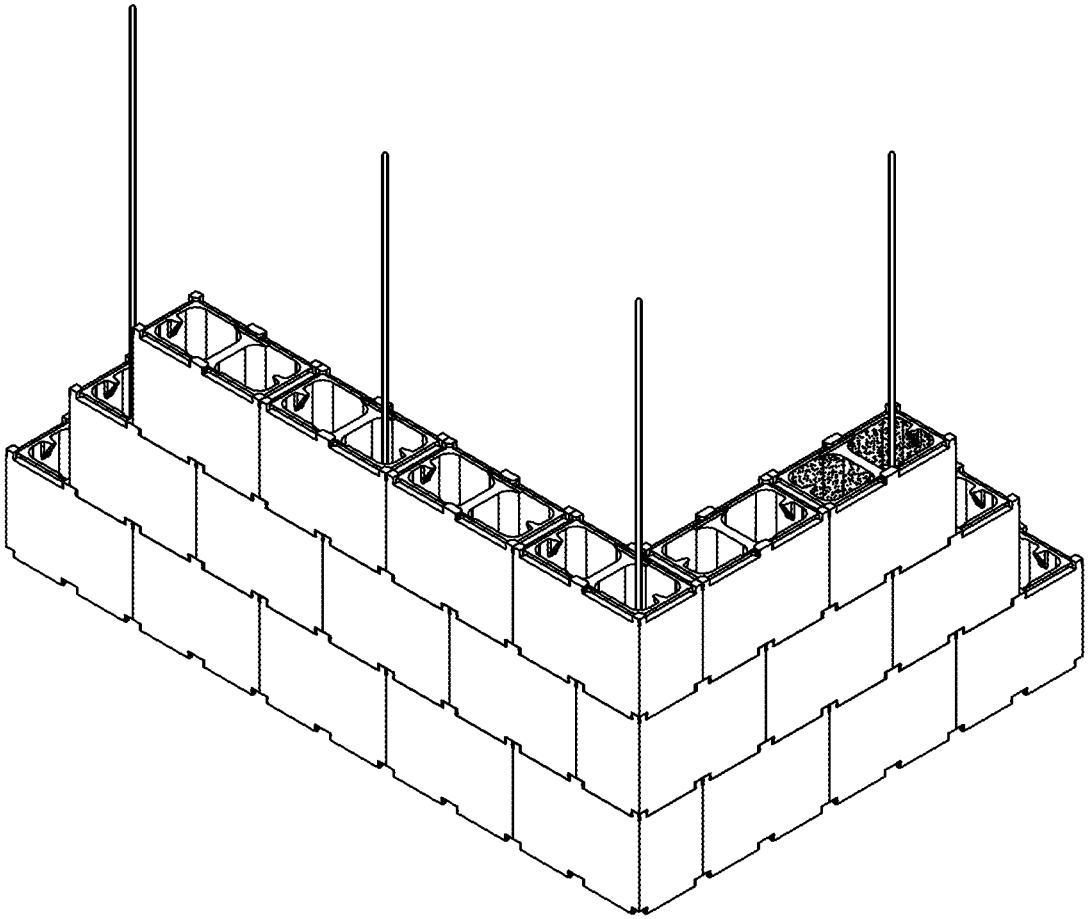
FIG. 14 schematically illustrates a ninety degree wall with sand and/or vertical support poles placed in the locking blocks.

FIG. 12 illustrates a ninety degree corner arrangement for locking blocks. As illustrated, two locking blocks of the bottom row are placed at a ninety degree angle and in the top row, a locking block is positioned to span the two locking blocks in the bottom row with the male and female features engaged. FIG. 13 illustrates an example of a double-wall construction with two parallel rows forming a bottom row and a locking block in the second row positioned at an angle of ninety degrees relative to the bottom row, which provides for a more robust and stable wall. As shown in FIG. 14, the locking blocks provide for the addition of sand or vertical support poles that strengthen and stabilize the wall, without affecting the ability to disassemble the wall easily and efficiently.

As is illustrated in FIGS. 11-14 when using an off-set construction style (i.e., for vertically adjacent rows and ninety degree corners, the locking blocks are off-set horizontally by one-half block length), the following are the pairings of male and female features. The male features identified as 125 on the top of the locking block 100 mate with the female features identified as 205 (or mate with the female features identified as 190 in ninety degree corners) on the bottom of the locking block 100. As illustrated in FIG. 11, two male features 125 are located side by side in one female feature 205. The male features identified as 140 on the top of the locking block 100 mate with a pair of female features identified as 190 on the bottom of the locking block (one female feature 190 from each of adjoining locking blocks in the lower row). The female features identified as 155 on the top of the long walls 150 of the locking block 100 mate with male feature identified as 175 on the bottom of the long walls 105 of the locking block 100. The male features 175 on the bottom of the short walls 110 mate with the top surface 117 of the central wall 115, which serves as a female feature that accommodates two male features 175 on the short walls 110 of two locking blocks. The female feather 155 on the top of the short walls 110 engage with the bottom surface 118 of the central wall 115.

An additional advantage of the locking block disclosed herein compared to prior art cinder blocks is a reduction of weight and an increase in mechanical properties for a similarly sized product. The approximate weight of a wall made from the traditional concrete cinder block is about 31.5 lb/ft$^2$, while using locking blocks described herein is about 14.7 lb/ft$^2$. Thus, a similar wall can be built using the locking blocks disclosed herein with about 50% lighter weight. Such an arrangement provides for significant less expensive transportation costs for the locking blocks and easier handling of the locking blocks during construction and deconstruction of the a wall or structure. The weight of an individual cinder block is about 40 to 45 lbs. The weight of the locking blocks discussed that are fabricated using a foam injection molding process can be as low as 22 lbs.

With regard to mechanical properties, a locking block fabricated from either polystyrene or recycled polystyrene has superior mechanical properties as compared to a traditional cinder block. For example, for compressive strength as tested per ASTM C67, a locking block fabricated from polystyrene has a compressive strength of about 3610 pounds per square inch (psi); a locking block fabricated from 100% recycled polystyrene has a compressive strength of about 3390 psi; and a traditional cinder block has a compressive strength of about 2560 psi. For example, maximum load as tested per ASTM C67, a locking block fabricated from polystyrene has a maximum strength of about 286,995 pound-force (lbf); a locking block fabricated from 100% recycled polystyrene has a maximum strength of about 269,505 lbf; and a traditional cinder block has a maximum strength of about 152,160 lbf. For example, water absorption as tested per ASTM C67, water absorption for a locking block fabricated from polystyrene is about 0.63%; water absorption for a locking block fabricated from 100% recycled polystyrene is about 0.79%; and water absorption for a traditional cinder block is about 8.08%. Other favorable properties for a polystyrene locking block include, for example: a fastener strength that requires 553 lbf to withdraw a #10×1 inch screw at ⅔ depth (using ASTM D6117); a creep measurement of 0.83% at 300 psi. for 10 years and a creep measurement of 1.47% at 600 psi. for 10 years (using ASTM D2990-17); and ultraviolet resistance of $\Delta E=0.54$ under conditions of 8 hours UV at 60° C., 4 hours concentration at 50° C. (using ASTM G154).

As has been noted, the interlocking mechanisms provides for a temporary wall or structure that can be quickly and efficiently constructed and later deconstructed and removed once it has fulfilled its usefulness. In addition, there is no damage done to the locking blocks during disassembly, so the locking blocks can be reused for additional projects. The locking blocks are well suited for use in emergency and temporary situations such as military, health applications, natural disasters, and the like.

The foregoing description of examples has been presented for purposes of illustration and description. It is not intended to be exhaustive or limiting to the forms described. Numerous modifications are possible in light of the above teachings. Some of those modifications have been discussed, and others will be understood by those skilled in the art. The examples were chosen and described in order to best illustrate principles of various examples as are suited to particular uses contemplated. The scope is, of course, not limited to the examples set forth herein, but can be employed in any number of applications and equivalent devices by those of ordinary skill in the art.

We claim:

1. A locking block comprising:

a first wall with a top surface and a bottom surface;

a second wall with a top surface and a bottom surface positioned opposite of the first wall;

a third wall with a top surface and a bottom surface positioned perpendicular to the first wall and the second wall and connecting the first wall to the second wall;

a fourth wall with a top surface and a bottom surface positioned opposite the third wall and positioned perpendicular to the first wall and the second wall and connecting the first wall to the second wall;

a first male feature positioned on the top surface of the first wall;

a second male feature positioned on the top surface of the second wall;

a third male feature positioned at an intersection of the top surface of the first wall and the top surface of the third wall;

a fourth male feature positioned at an intersection of the top surface of the first wall and the top surface of the fourth wall;

a fifth male feature positioned at an intersection of the top surface of the second wall and the top surface of the third wall;

a sixth male feature positioned at an intersection of the top surface of the second wall and the top surface of the fourth wall;

a first female feature positioned in the top surface of the first wall and located between the first male feature and the third male feature;

a second female feature positioned in the top surface of the first wall and located between the first male feature and the fourth male feature;

a third female feature positioned in the top surface of the second wall and located between the second male feature and the fifth male feature;

a fourth female feature positioned in the top surface of the second wall and located between the second male feature and the sixth male feature;

a fifth female feature positioned in the top surface of the third wall and located between the third male feature and the fifth male feature; and a sixth female feature positioned in the top surface of the fourth wall and located between the fourth male feature and the sixth male feature.

2. The locking block of claim 1, further comprising:

a seventh female feature positioned in the bottom surface of the first wall;

an eight female feature positioned in the bottom surface of the second wall;

a ninth female feature positioned at an intersection of the bottom surface of the first wall and the bottom surface of the third wall;

a tenth female feature positioned at an intersection of the bottom surface of the first wall and the bottom surface of the fourth wall;

an eleventh female feature positioned at an intersection of the bottom surface of the second wall and the bottom surface of the third wall;

a twelfth female feature positioned at an intersection of the bottom surface of the second wall and the bottom surface of the fourth wall;

a seventh male feature positioned on the bottom surface of the first wall and located between the sixth female feature and the ninth female feature;

an eight male feature positioned on the bottom surface of the first wall and located between the seventh female feature and the tenth female feature;

a ninth male feature positioned on the bottom surface of the second wall and located between the eighth female feature and the eleventh female feature;

a tenth male feature positioned on the bottom surface of the second wall and located between the seventh female feature and the twelfth female feature;

an eleventh male feature positioned on the bottom surface of the third wall and located between the ninth female feature and the eleventh female feature; and a twelfth male feature positioned on the bottom surface of the fourth wall and located between the tenth female feature and the twelfth female feature.

3. The locking block of claim 2, wherein the length of the first wall is equal to the length of the second wall and the length of the third wall is equal to the length of the fourth wall.

4. The locking block of claim 3, wherein the length of the first wall and second wall is greater than the length of the third wall and fourth wall.

5. The locking block of claim 1, wherein the first male feature is located at a horizontal midpoint of the first wall and the second male feature is located at a horizontal midpoint of the second wall.

6. The locking block of claim 2, wherein the seventh female feature is located at a horizontal midpoint of the first wall and the eighth female feature is located at a horizontal midpoint of the second wall.

7. The locking block of claim 2, wherein the third male feature, fourth male feature, fifth male feature, and sixth male feature are generally cubical in shape.

8. The locking block of claim 2, wherein the first male feature and second male feature are generally cuboid in shape.

9. The locking block of claim 2, further comprising a central wall extending from a midpoint of the first wall to a midpoint of the second wall.

10. The locking block of claim 1, wherein the locking block is fabricated from a polymer.

11. The locking block of claim 10, wherein substantially all of the polymer is recycled polymer.

12. The locking block of claim 10, wherein the polymer is at least one thermoplastic polymer.

13. The locking block of claim 12, wherein the polymer is a blend of two or more thermoplastic polymers.

14. The locking block of claim 10, wherein the polymer is a polystyrene.

15. The locking block of claim 14, wherein the mineral particles are added to the polystyrene.

16. The locking block of claim 10, wherein the polymer is polycarbonate.

17. The locking block of claim 10, where the polymer is SAN.

18. The locking block of claim 10, where the polymer is polypropylene.

19. The locking block of claim 11, wherein the process used to fabricate the locking block is an injection molding foaming process.

20. The locking block of claim 11, wherein the locking block can be cut using traditional cutting techniques.

* * * * *